United States Patent [19]

Klocker

[11] Patent Number: 4,671,327

[45] Date of Patent: Jun. 9, 1987

[54] WEAVING MACHINE INCLUDING A DEVICE FOR FORMING A LENO EDGE

[75] Inventor: Heinrich J. Klocker, Borken, Fed. Rep. of Germany

[73] Assignee: Klocker-Entwicklungs-GmbH, Borken, Fed. Rep. of Germany

[21] Appl. No.: 769,865

[22] Filed: Aug. 27, 1985

[30] Foreign Application Priority Data

Aug. 27, 1984 [DE] Fed. Rep. of Germany ..... 3431442
Nov. 19, 1984 [DE] Fed. Rep. of Germany ..... 3442204

[51] Int. Cl.[4] ..... D03C 11/00
[52] U.S. Cl. ..... 139/54
[58] Field of Search ..... 139/54, 430

[56] References Cited

U.S. PATENT DOCUMENTS

| | | | |
|---|---|---|---|
| 3,191,634 | 6/1965 | Hall | 139/54 |
| 3,256,913 | 6/1966 | Neumann | 139/54 |
| 3,741,256 | 6/1973 | Wessler | 139/54 |
| 4,478,256 | 10/1984 | Klocker | 139/54 |

*Primary Examiner*—Henry S. Jaudon
*Attorney, Agent, or Firm*—Collard, Roe & Galgano

[57] ABSTRACT

A weaving machine including a device for forming a leno edge is provided wherein the machine has reciprocally moving shafts in which at least one warp thread holder is supported by means of a frame and is arranged on a first one of the shafts for guiding at least one warp thread. A thread guiding device is arranged on a second one of the shafts being guided by the machine frame and having a slanted slot with a support catch at one end thereof for guiding the leno yarn.

12 Claims, 22 Drawing Figures

WEAVING MACHINE INCLUDING A DEVICE FOR FORMING A LENO EDGE

The present invention relates to a weaving machine, and, more particularly, to a weaving machine including a device for forming a leno edge. The weaving machine is provided with reciprocally moving shafts and several warp thread holders preferably supported by a rack arranged on one of the shafts for guiding the warp threads.

In a known weaving machine of this type, several warp thread holders are arranged on each shaft by means of a frame or rack. In the one final position of the shafts, the ends of the holders show a spacing for the purpose of forming a shed in the direction of stroke. For producing a leno edge, such a machine uses a leno thread guided by a leno thread holder designed in the form of a swiveling lever which, in the one position wherein the shed is formed, performs a motion correspondingly crosswise or transverse with respect to said shed, so that the leno yarn is jointly intertwined or therein. This design requires a special or separate drive for the swiveling lever, by means of which the leno yarn is reciprocally woven.

It is an object of the present invention to provide a weaving machine including a device for producing a leno edge of the type specified above which is capable of working without a swiveling lever and without a special drive for the leno yarn guided by the swiveling lever.

According to the present invention this object is accomplished by arranging on the second of said shafts of the weaving machine a thread or yarn guiding device, this device being guided by the machine frame or rack, wherein the yarn guiding device has a slanted slot with a support catch on one end thereof for guiding the leno yarn. This device works with two threads, i.e., with the warp thread and the leno yarn. The device has the advantage that in this way, a durable mesh is produced at favorable cost.

The device according to the present invention is used on each of the two sides of the fabric for forming an edge on a weaving machine. The slanted slot is arranged in the thread guiding device in such a way that the support catch is directed inwardly, i.e., towards the center of the fabric. This arrangement has the special advantage that due to the natural tension of the fabric which tends to contract the fabric, the leno yarn or thread safely runs into the support catch.

If a firmer leno edge is desired, the thread or yarn guiding device may be provided with a plurality of slanted slots, preferably two parallel slanted slots. In this case, the device works with two warp threads and two leno yarns.

According to a special embodiment, the slanted slots may be disposed in the yarn guiding device with a mirror-inverted arrangement with respect to each other. With such an arrangement, the deflecting surfaces of the warp thread holders will also be arranged inverted with respect to each other. This embodiment is used particularly if the web of fabric produced on a loom is to be cut on completion in the longitudinal direction, so that each web of fabric has within the area of the cut edge its own leno edge preventing the fabric from coming apart.

Another possibility of producing a firm leno edge is to use three warp threads and one leno yarn. In this case, the thread guiding device has an opening for guiding the third warp thread, the two other warp threads running through the openings provided in the warp thread holders. The opening for guiding the third warp thread in the thread guiding device is arranged within the area of the top end of the slanted slot provided in the thread guiding device. Thus, in this location the warp is disposed slightly above or on the same level as the leno yarn, with the opening being disposed preferably between the two warp thread holders (needles). The slanted slot, with this arrangement, extends in the horizontal direction slightly beyond the outer spacing of the warp thread holder needles.

In detail, the individual devices are designed in such a way that the thread holder for guiding the warp thread is provided in the form of a needle, whereby the needle associated with the support catch has a deflecting surface on its end which lifts the yarn present in the catch from the catch after the reversing motion of the shafts. With this arrangement, the slanted slot associated with the respective warp holder slightly exceeds in its horizontal extension the thickness of the respective warp holder needle.

According to another feature of the present invention, the diameter of the warp thread holder or needle is reduced preferably below the opening for the warp within the area of contact of the leno yarn, so that a reduction in cross section of the needle results in this area. This slightly reduces the tension of the leno yarn before running into the support catch of the slanted slot, so that entry of the leno yarn into the catch is assured.

Furthermore, the warp thread holder (needle) may be turned as by adjustment by a defined angle around its longitudinal axis, preferably by an an angle of 30°, so that the opening for the warp thread may be disposed slanted relative to the plane of stroke of the thread guiding device. The advantage of this embodiment is that a higher tension is applied to the leno yarn when the yarn is lifted by the deflecting surface of the warp thread holder, so that the leno yarn is safely pushed out of the support catch.

With all the embodiments described in the foregoing, the transverse motion of the leno yarn for the purpose of weaving the mesh or linkage formed by the warp and the weft yarn is caused by the slanted slot, which moves the leno yarn transversely to the direction of stroke of the shafts.

Other objects and features of the present invention will become apparent from the following detailed description considered in connection with the accompanying drawings. It is to be understood, however, that the drawings are designed as an illustration only and not as a definition of the limits of the invention.

In the drawings wherein similar reference characters denote similar elements throughout the several views.

Figure 1:
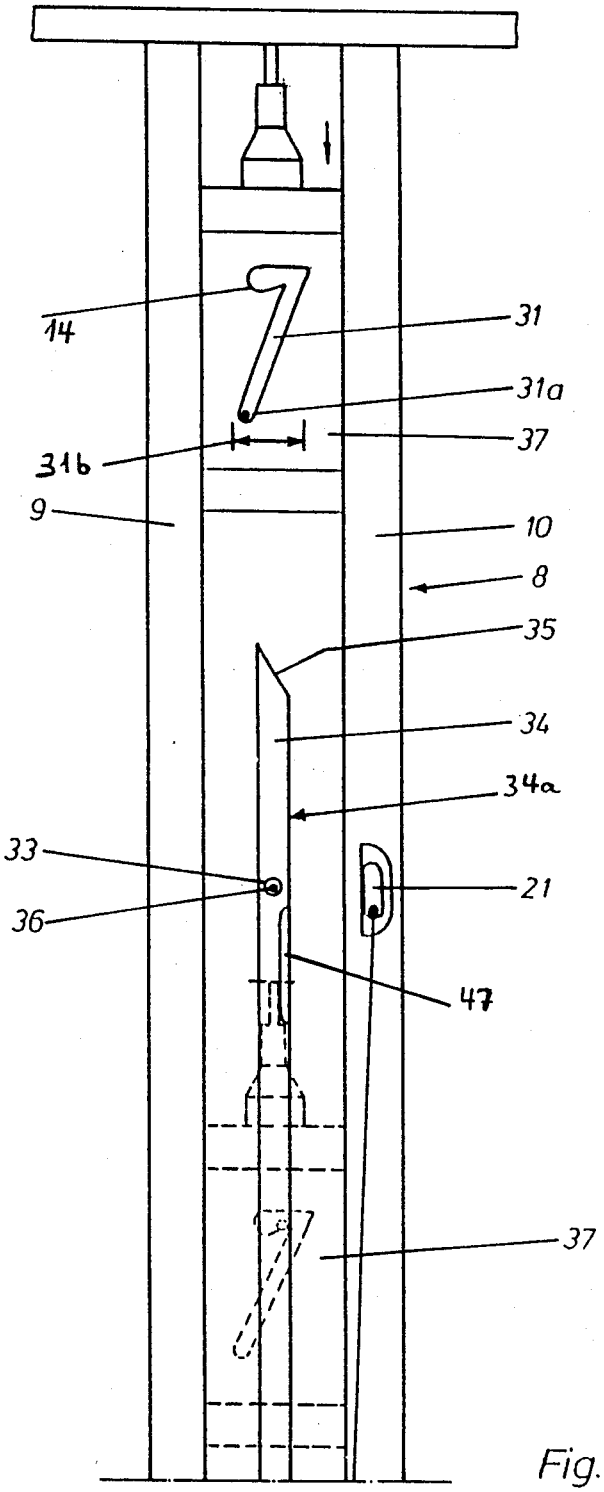
FIG. 1 shows a first embodiment of a weaving machine incorporating the device of the present invention with two threads or yarns, in a view omitting the shafts.
Figure 6:
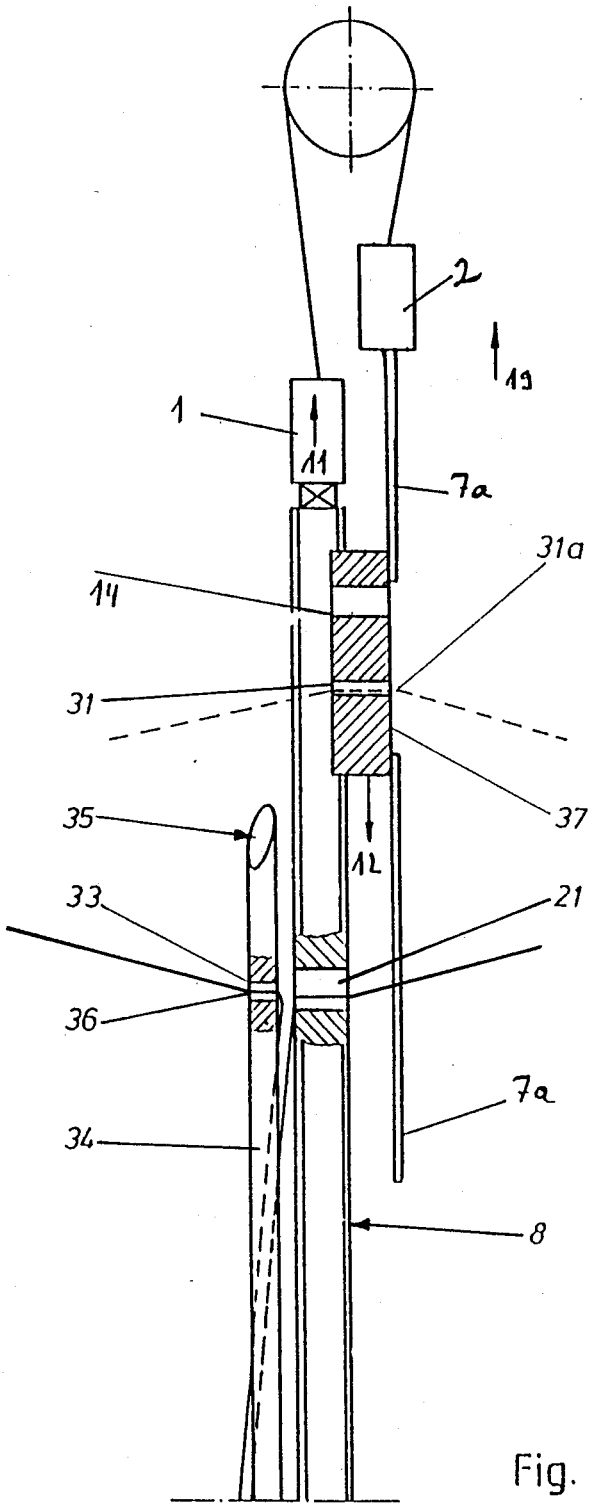
FIG. 6 is a side view, partly in cross-section of the embodiment of FIG. 1.
Figure 7:
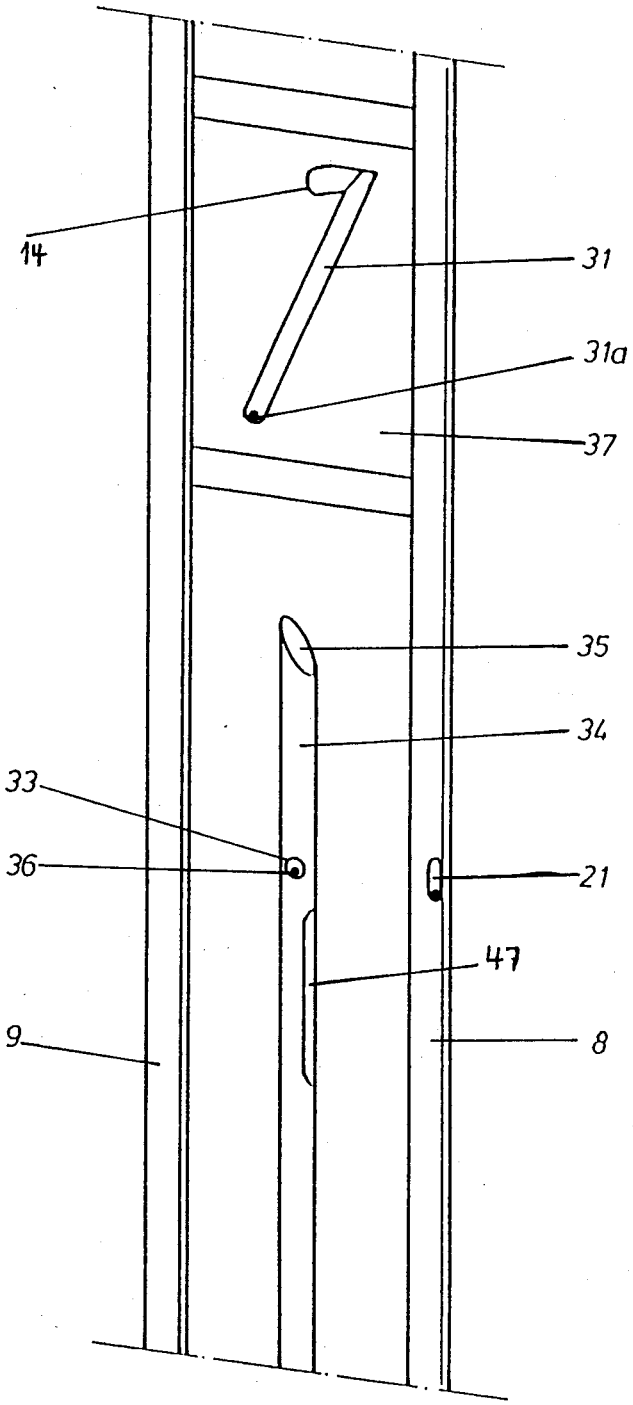
FIG. 7 is a perspective view of the embodiment of FIG. 1.

Now turning to the drawings, the embodiment of the weaving machine according to FIGS. 1 to 7 for producing a leno edge has a shaft 1 and a shaft 2, as shown in FIG. 6, which may be reciprocally guided, for example by means of a roller. The lower shafts are omitted in FIG. 6. The warp thread holder 34 in the form of a needle is arranged and mounted on shaft 1. Said needle has an opening 33 for guiding warp thread 36. Warp thread holder 34 is guided by rack or frame 8 basically consisting of two parallel rack rails 9 and 10, as seen in FIG. 1, said rails having an approximately U-shaped cross sectional shape. A thread guiding device, generally designated 37, is arranged on the other shaft 2. By said identical rails 9 and 10 of the frame, thread or yarn guiding device 37 is guided like a coulisse, with connecting means 7*a* being provided for the connection with shaft 2. Thus, for example, when shaft 1 is moved in the direction of arrow 11 in FIG. 6, thread guiding device 7 moves in the direction of arrow 12.

Thread guiding device 37 is provided with a slanted slot 31 having at its top end a support catch 14. The leno yarn 31*a* is disposed in slanted slot 31, which, with respect to its horizontal reach 31*b*, exceeds the thickness of warp thread holder 34, which permits the leno yarn to run in the course of the stroke along the outer surface 34*a* of warp thread holder 34. The warp thread 36 pulled through opening 33 in the warp thread holder or needle 34 exits on the side of rail 10 via an opening 21, so that the thread guiding device is capable of performing its stroke without being obstructed in such motion. FIG. 6 shows that warp thread 36 extending through opening 33 is first guided downwardly, where it is reversed, and then guided upwardly through opening 21.

Figure 2:
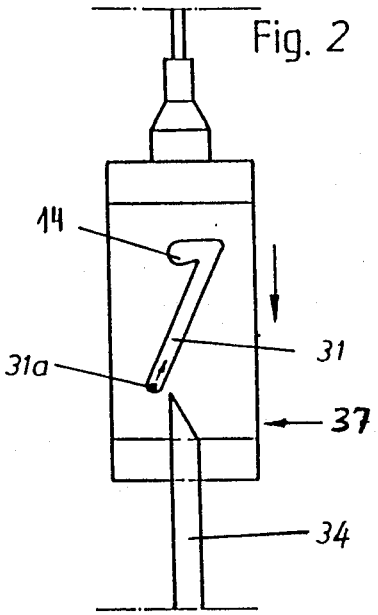
FIGS. 2 to 5 show different positions of the warp thread holder of the weaving machine of FIG. 1 relative to the thread guiding device, and the corresponding position of the leno yarn.
Figure 3:
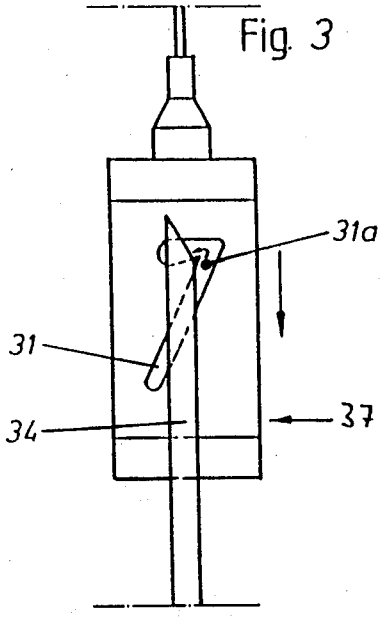
Figure 4:
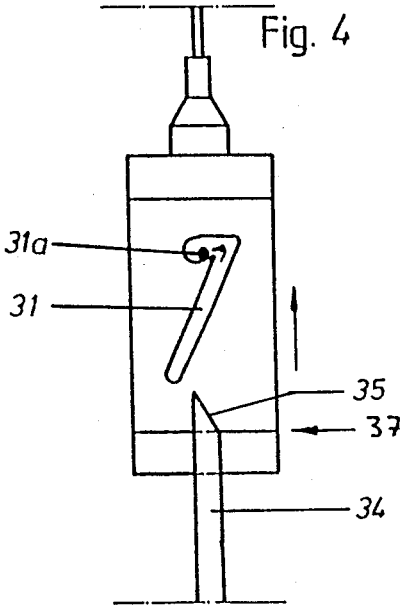
Figure 5:
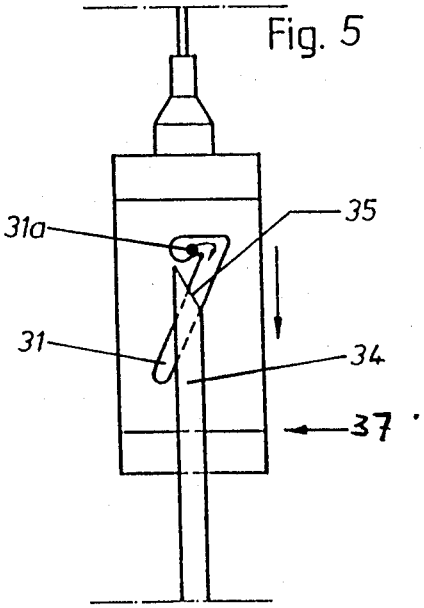

The mode of operation of the machine according to FIGS. 1 to 7 is described as follows:

After the shafts have reached the position shown in FIGS. 1 and 2, warp thread 36 extending through opening 33 and leno yarn 31*a* form a shed; leno yarn 31*a* is disposed in slanted slot 31 at the bottom end thereof. When shaft 2 moves in the direction of arrow 12 (FIG. 6), leno yarn 31*a* in slanted slot 31 is first caused to run along the outer surface 34*a* of needle 34 (see also FIGS. 4 and 5). A shed is formed by the further motion beyond the intersection of the warp and leno yarns, and a weft is placed into said shed (not shown). However, said weft thread is not yet woven or linked up. With the following reversed motion of shaft 2 in the direction of arrow 19, the leno yarn is caused to run along the outer surface 34*a* of needle 34 until it reaches the end of needle 34 at point 35, whereby the leno yarn is capable of performing the transverse motion in the newly formed shed because it is resting in the support catch 14 (FIG. 1, see the dot-dash position of thread guiding device 37). Thus, only after the second shed has been formed are the warp thread and the weft thread intertwined by leno yarn 31*a*.

With the next-following, renewed reverse motion in the direction of arrow 12, deflecting surface 35 of needle 34 causes leno yarn 31*a* to be lifted from support catch 14 and to run along the outer surface 34*a* of needle 34 until it reaches the point of reversal at the bottom, whereby a shed is formed at the same time. Here, a weft thread is placed in position, but not yet woven with the help of the leno yarn. Only when a new shed is formed with the next reversed motion in the direction of arrow 19, said weft is woven when or after the leno yarn 31*a* now running along the outer surface 34*a* has reached the end of needle 34 at point 35 and can now perform the transverse motion causing the weft to be woven with the warp, because the leno yarn has reached the bottom end of the slot 31 after it has crossed the intersection or point of intersection of the warp.

Consequently, weaving is caused by leno yarn 31*a* only after each second formation of a shed because following each transverse motion (by which a weft is placed in position in the shed for weaving), the leno yarn first moves along outer surface 34*a* of needle 34.

The embodiment of the machine according to FIGS. 8 to 14 for producing a leno weave edge has a shaft 1 and a shaft 2, which shafts may be reciprocating, for example by means of a roller. The warp thread holders 17 (FIG. 9) designed in the form of the two needles 4 and 5 are arranged on shaft 1, said needles are provided with openings 6 for guiding warp threads 6*a* and 6*b*, respectively. Needles 4 and 5 are guided by a frame 8 basically comprised of the two parallel rails 9 and 10 having an approximately U-shaped cross-sectional shape. A thread guiding device, generally designated 7, is arranged on shaft 2. The two rails 9 and 10 guide thread guiding device 7 like a coulisse, with connecting means 7*a* being provided for the connection with shaft 2.

Thus, when shaft 1 is caused to move in the direction of arrow 11, thread guiding device 7 is caused to move in the direction indicated by arrow 12. Thread guiding device 7 is provided with a slanted slot 13 having a support catch 14 at the top end thereof. Leno yarn 13*a* is accommodated in slanted slot 13. An opening 15 for guiding a third warp thread 15*a* is provided within the area of the upper end of slanted slot 13. Slanted slot 13 has a horizontal reach extending in such a way that its ends permit the leno yarn disposed at said ends to run along the outer surface 5*a* of needle 5. Opening 15 for the warp thread 15*a* is disposed between the warp thread holders or needles 4 and 5, thus in the center with respect to said needles.

Figure 10:
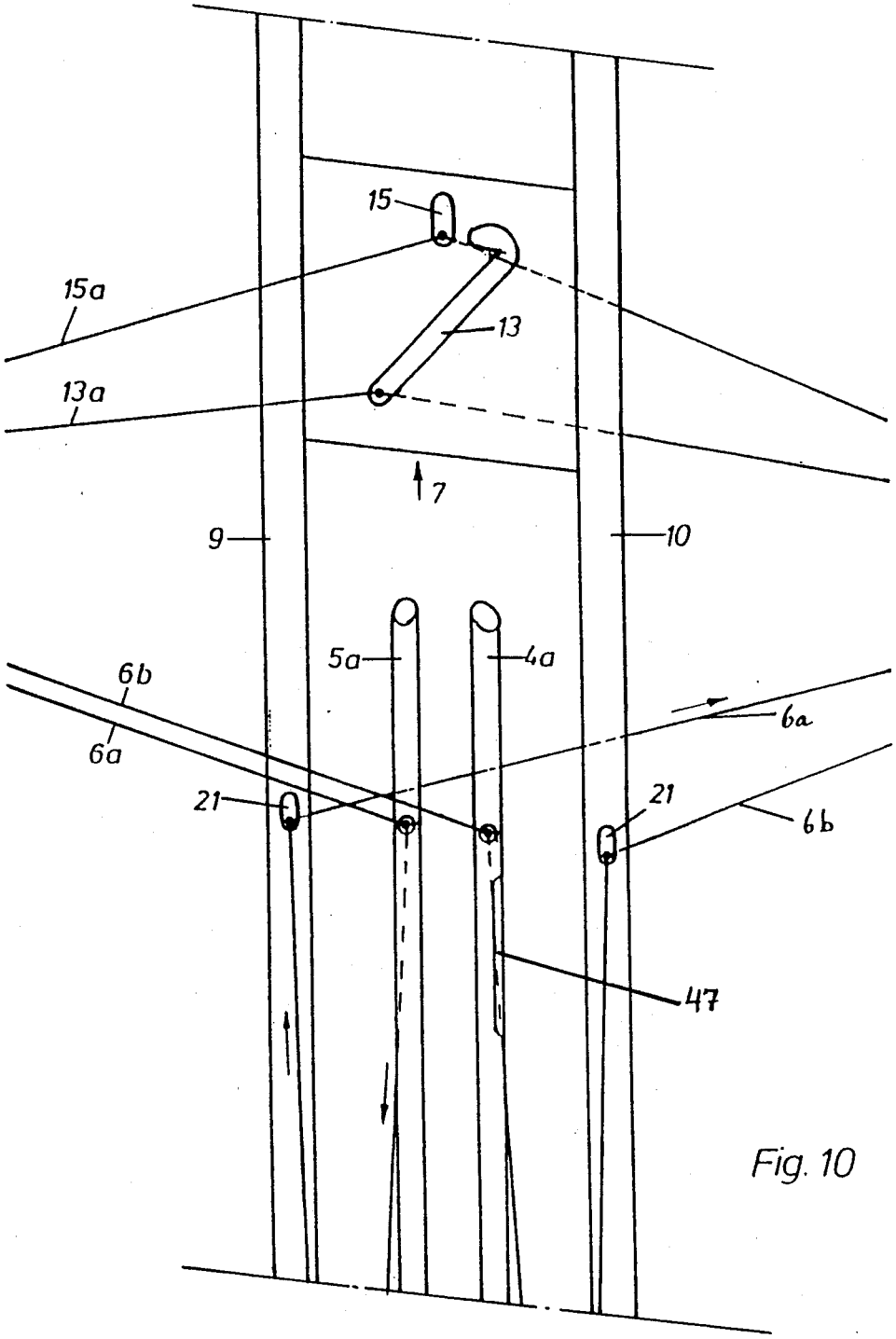
FIG. 10 is a perspective view of the embodiment of FIG. 8.
Figure 11:
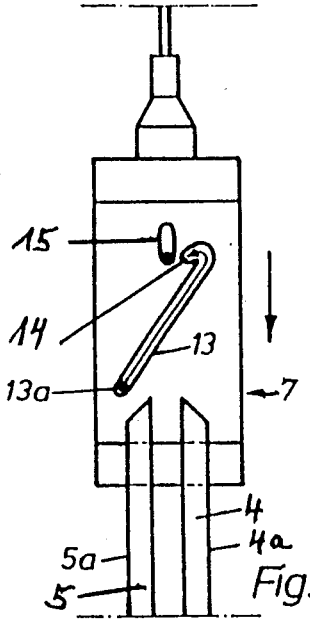
FIGS. 11 to 14 show different positions of the warp holders of the embodiment of FIG. 8 relative to the thread guiding device, and the corresponding position of the leno yarn.
Figure 12:
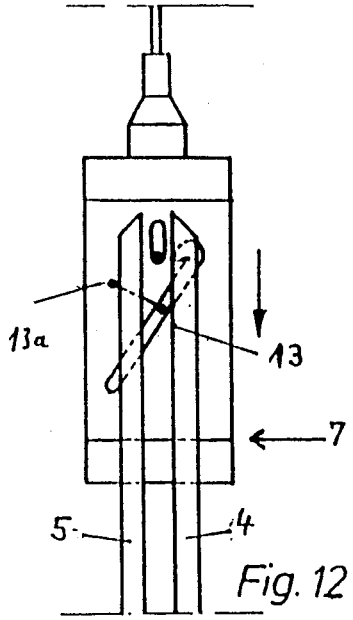
Figure 13:
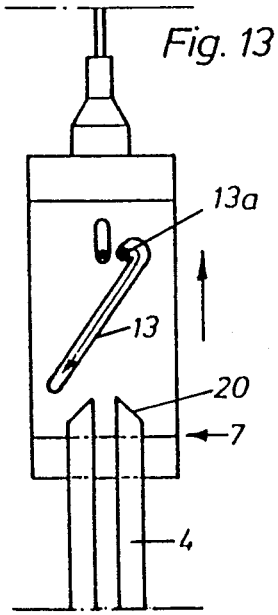
Figure 14:
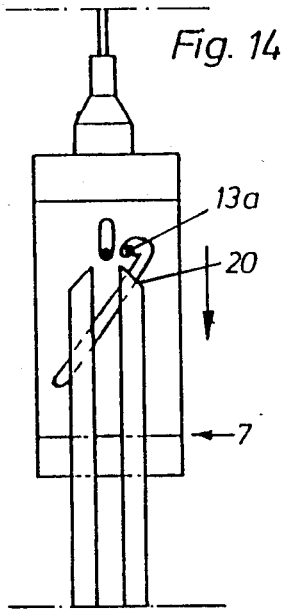

The warp threads extending through openings 6 in the warp thread holders or needles 4 or 5 exit on the side of the frame rails 9 or 10 via an opening 21 in order not to interfere with the stroke of the thread guiding device. FIG. 10 shows that each warp thread 6*a* and 6*b* extending through opening 6 is first guided downwardly, reversed there and then guided upwardly through opening 21.

Figure 8:
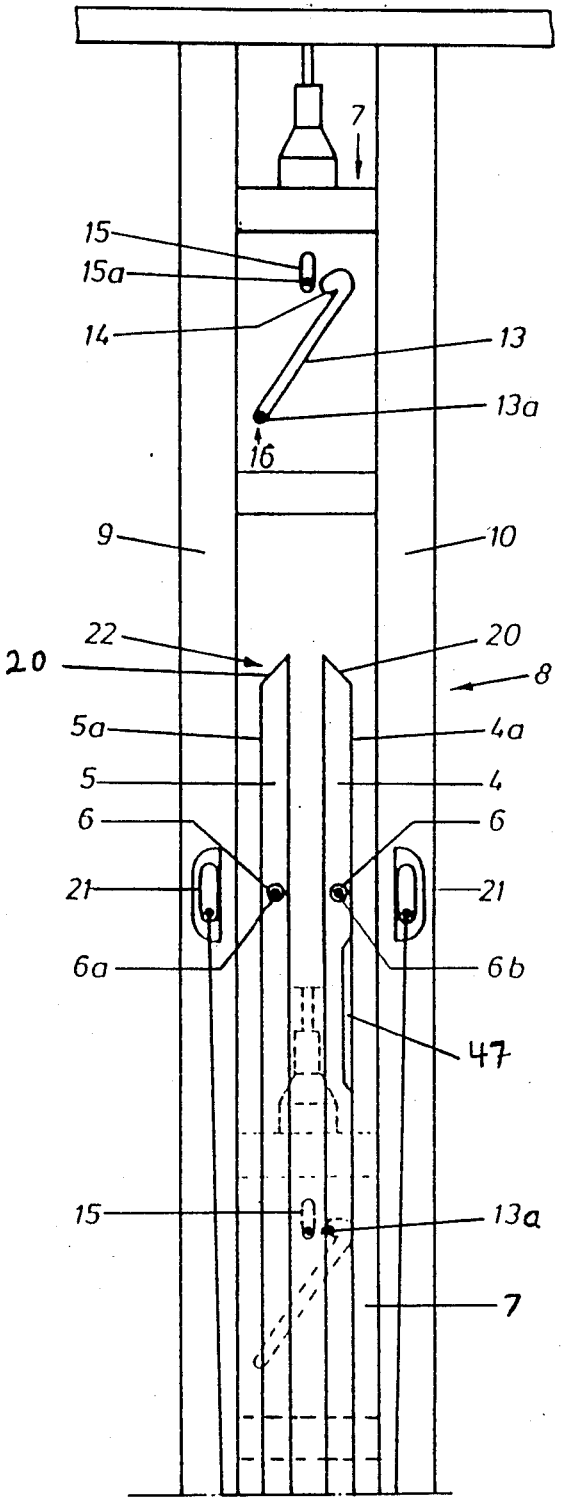
FIG. 8 shows a second embodiment of a weaving machine incorporating the device of the present invention with four yarns, in a view omitting the shafts.
Figure 9:
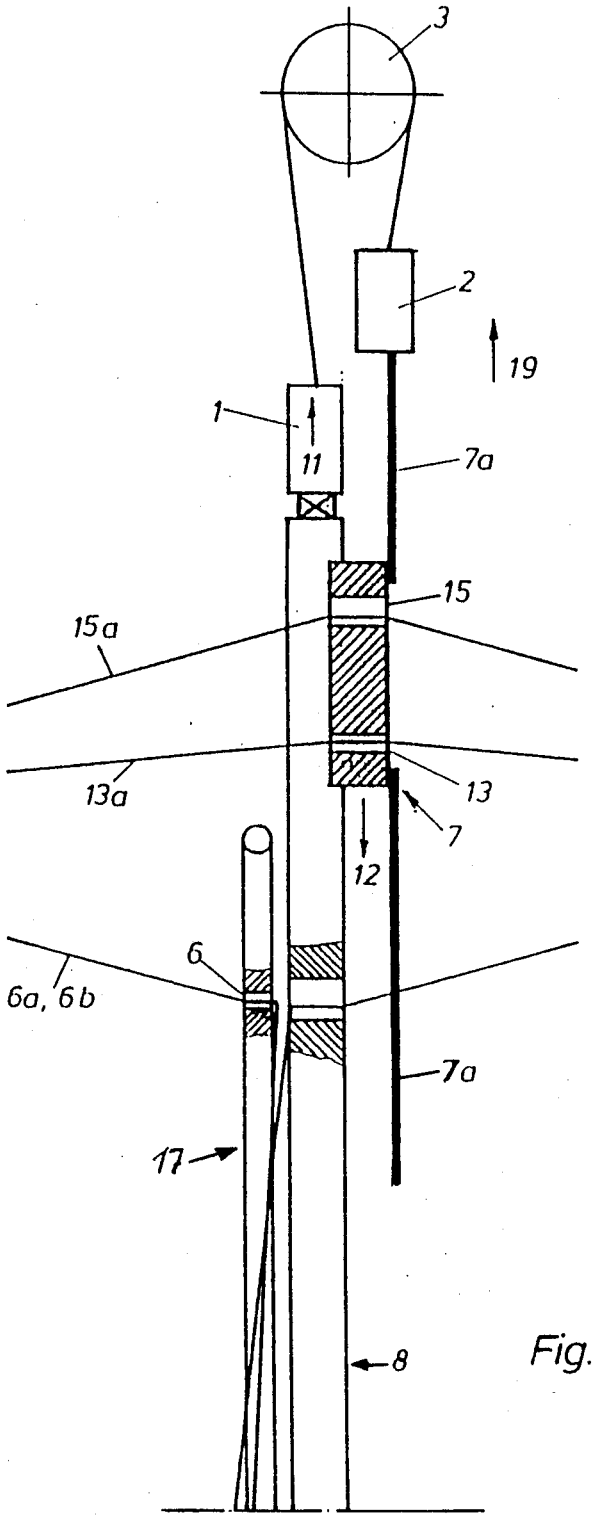
FIG. 9 is a side view, partly in cross-section of the embodiment of FIG. 8.

The mode of operation of the device according to FIGS. 8 to 14 is basically the same as that of the first embodiment of the device described above. However, the mode of operation is described once more for the sake of better understanding:

After the shafts have reached the position shown in FIGS. 8 and 9, an a shed is formed by warp threads 6*a*, 6*b*, or 15*a*, respectively, extending through openings 6 and 15, respectively. Leno yarn 13*a* is accommodated in slanted slot 13 at the bottom end at point 16. When shaft 2 moves in the direction of arrow 12, leno yarn 13*a* in slanted slot 13 is caused to first run along the outer surface 5*a* of needle 5 (see also FIGS. 4 and 5), and a shed is formed by the further motion beyond the point of intersection of the warps, into which shed a weft thread is placed. However, said weft is not yet woven. When shaft 2 reverses in the direction of arrow 19, the leno yarn moves along the outer surface 5*a* of needle 5 until it has reached the end of needle 5 at point 22, whereby the leno yarn can now move transversely in the newly formed shed because it is accommodated in support catch 14 (see dot-dash position of the thread guiding device 7 in FIG. 8). This means that leno yarn 13*a* has woven the warps with the weft only after the second formation of a shed.

With the next-following reversed motion in the direction of arrow 12, deflecting surface 20 of needle 4 causes leno yarn 13*a* to be lifted from support catch 14 and to run along the outer surface 4*a* of needle 4 until it has reached the bottom point of reversal, forming at the same time another shed. Here, another weft is placed in position, but not yet woven by the leno yarn.

Only after another new shed has been formed and a weft placed by the renewed reversal or reversed motion in the direction of arrow 19, is the weft woven when leno yarn 13*a* running along outer surface 4*a* has reached the end of needle 4 at point 22, permitting the leno yarn to now move transversely in order to the weave the weft with the warps, because after the leno yarn has passed beyond the point of intersection of the warp, it has reached the bottom end of slot 13 at point 16.

Thus, weaving by leno yarn 13*a* only takes place after each second formation of a shed because after each transverse movement, the leno yarn first moves along the outer surfaces 5*a* and 4*a* of the needles 5 and 4, respectively.

Figure 15:
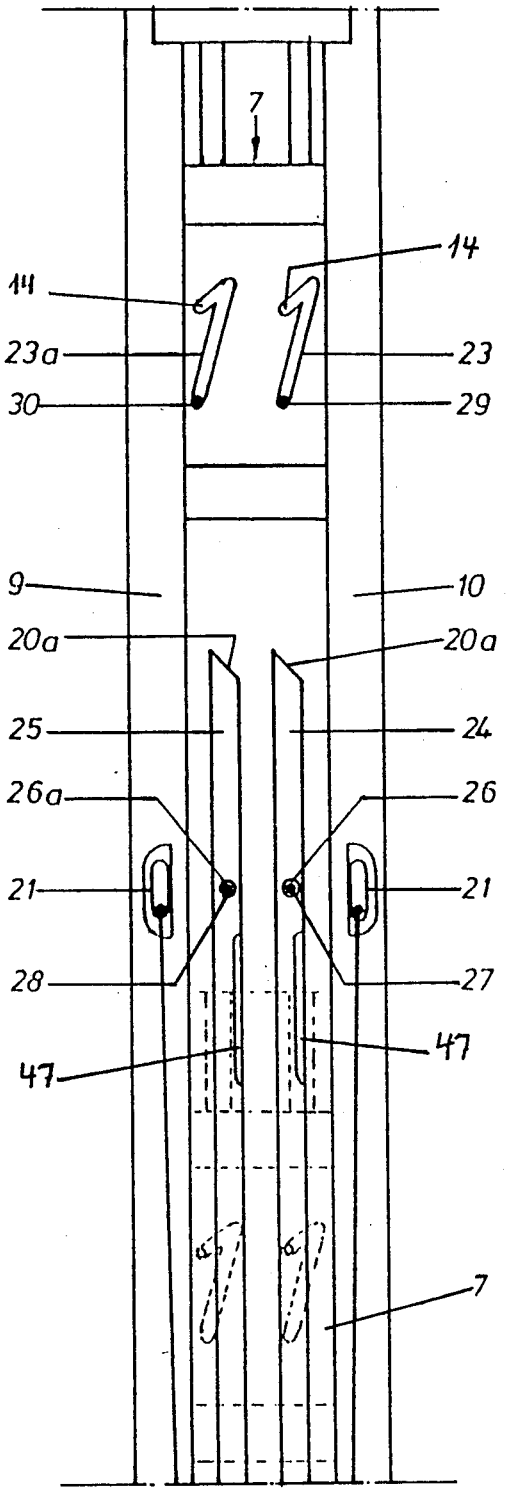
FIG. 15 shows a third embodiment of a weaving machine incorporating the device of the present invention, with two warps and two leno yarns for producing the leno edge, said device being designed to produce a double leno edge.
Figure 16:
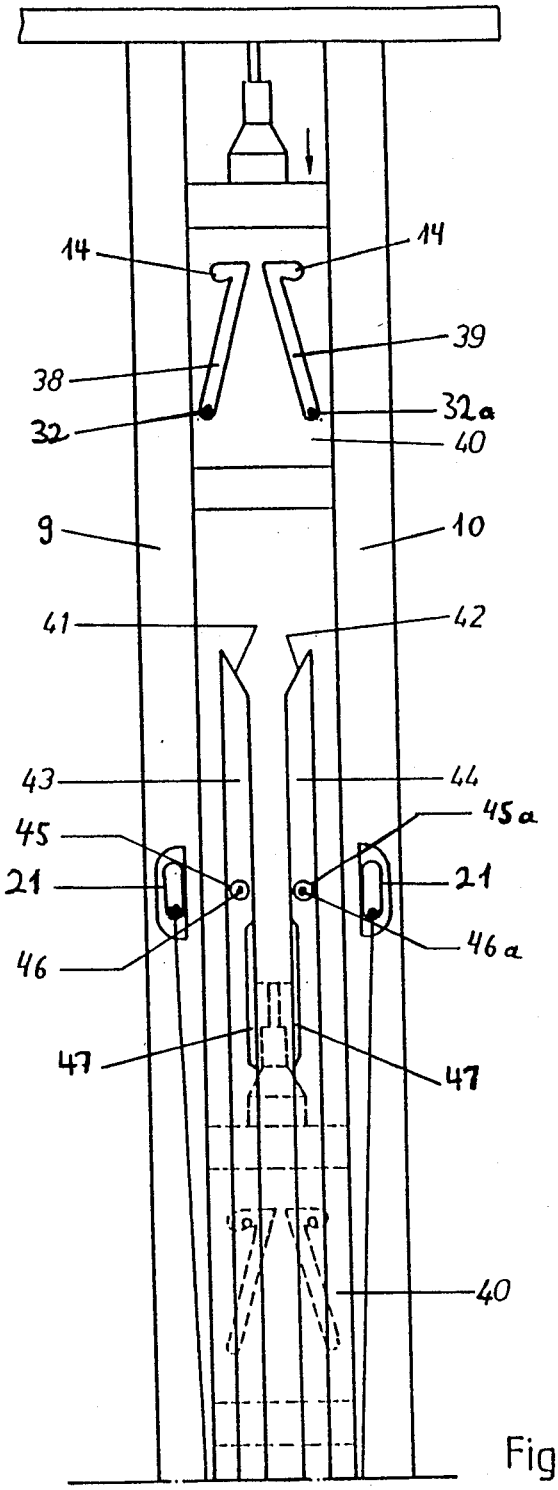
FIG. 16 shows a fourth embodiment of a weaving machine incorporating the device of the present invention with four threads or yarns, in a view omitting the shafts.
Figure 17:
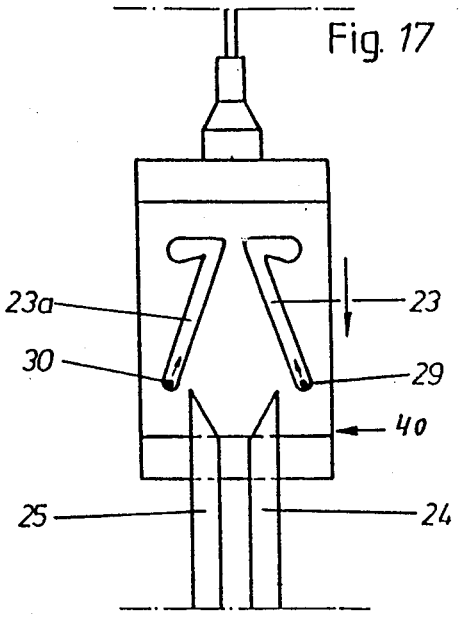
FIGS. 17 to 20 show different positions of the warp holders of the embodiment of FIG. 16 relative to the thread guiding device, and the corresponding position of the leno yarn.
Figure 18:
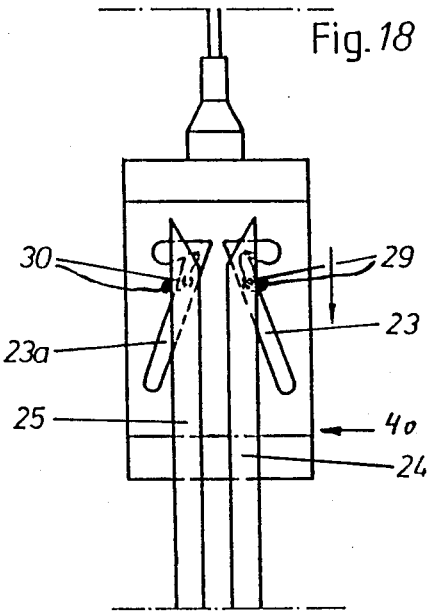
Figure 19:
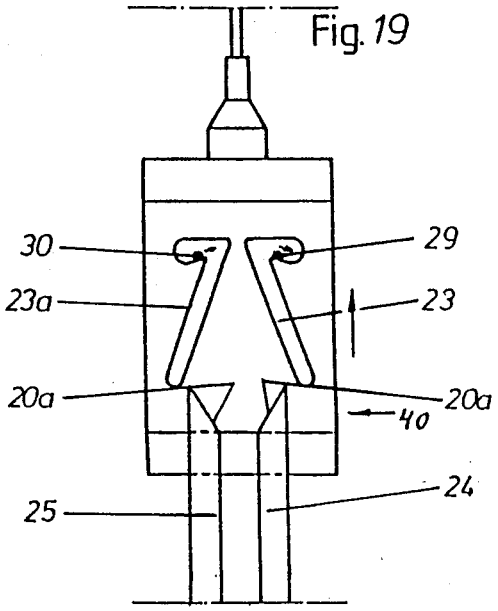
Figure 20:
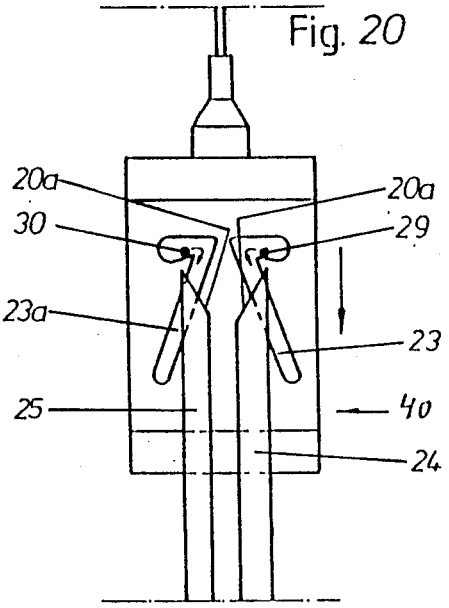
Figure 21:
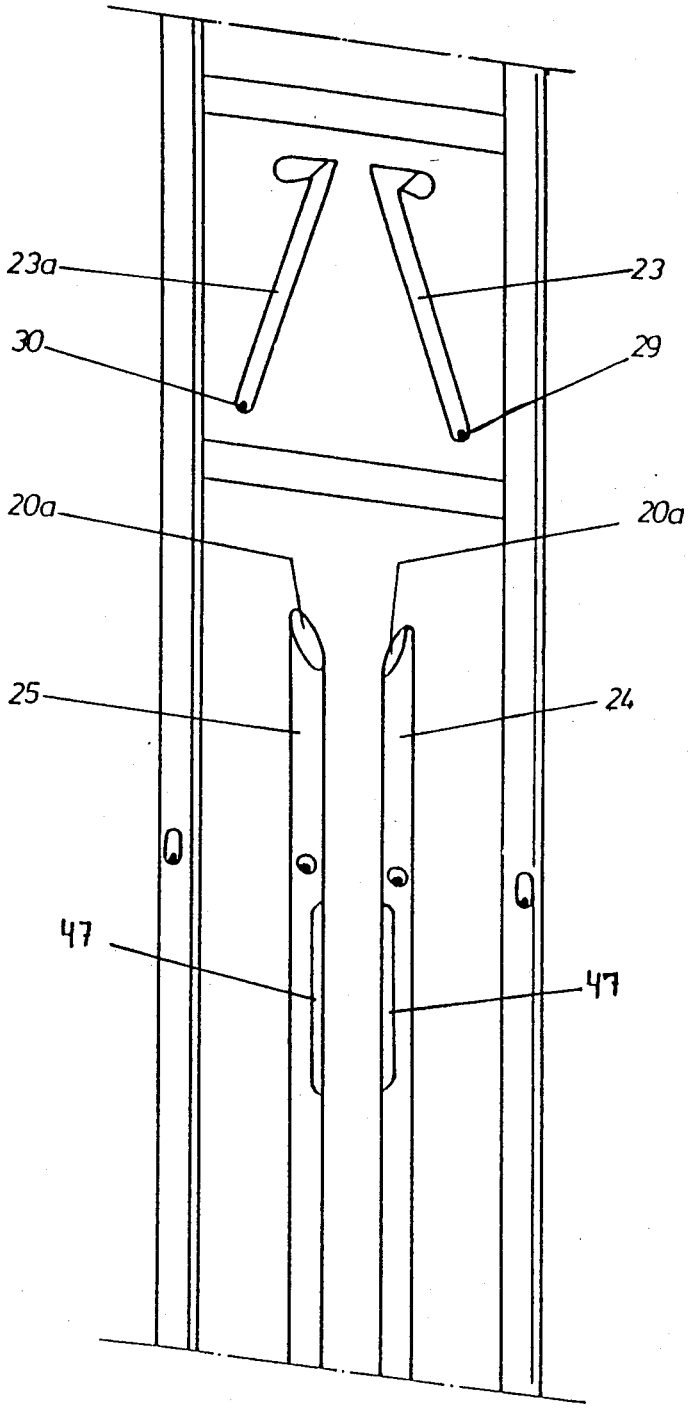
FIG. 21 is a perspective view of the embodiment of FIG. 16.

In the third embodiment according to FIG. 15, the device is worked with two warp threads and two leno yarns. Warp thread holder 24 has the design of a needle with an opening 26 for warp thread 27 and is associated with slanted slot 23 for leno yarn 29. Slanted slot 23*a* for leno yarn 30 is associated with warp thread holder 25 designed as a needle with an opening 26*a* for warp thread 28. Both needles have a deflecting surface 20*a* having the same function as the deflecting surface 20 of the device according to FIGS. 1 to 7.

With the device according to FIG. 15, a shed is formed by warp thread 27 and leno yarn 29 in slanted slot 23, or warp thread 28 and leno yarn 30. The transverse movement with the help of the slanted slot 29 or 30 is achieved in the same way as with the embodiment according to FIGS. 1 to 7, however, in this case, the leno edge is not as firm or solid as the one produced by means of the device according to FIGS. 8 to 14. Thus, with the present embodiment, two leno edges are produced, whereby one leno edge serves for weaving the weft thread and the other leno edge serves for engaging or weaving the projecting ends of the weft, so that the end pieces of the weft supported by the leno yarn can be cut off.

With the fourth embodiment according to FIGS. 16 to 21, wherein the two slanted slots 38 and 39 are diposed in yarn-guiding device 40 with a mirror-inverted arrangement, the same weave as with the first embodiment is produced, but with a double structure, where, however, the direction of rotation of the leno yarn in each structure is different, or in another direction. The field of application for such a device is the manufacture of fabric which, on completion, is cut apart in the center, where a few warp threads have been left out. Thus, both edges of the fabric, when cut apart, have a leno edge preventing disintegration of the fabric.

Also, with the present device, one warp thread 46 or 46*a* and one leno yarn 32 or 32*a* is used. Warp thread holder 43 or 44 having the design of a needle is associated in each case with a slanted slot 38 or 39, respectively, for leno yarns 32 and 32*a*, respectively. Each warp thread holder or needle 43 or 44 has an opening 45 or 45*a*, respectively, through which the warp 46 or 46*a*, respectively, is guided. Both needles 43 and 44 have at their ends a deflecting surface 41 and 42, respectively, which are disposed in a mirror-inverted arrangement in accordance with the arrangement of slanted slots 38 and 39 in thread guiding device 40.

With all four embodiments of the device, the diameter of the warp thread holder or needle is reduced within the area of contact with the leno yarn below the opening for the warp thread, resulting in a reduced cross section 47. In this way, the tension of the leno yarn is slightly reduced, assuring that the leno yarn is always running into the support catch 14 of the slanted slot.

Furthermore, with all four embodiments of the device (see in particular FIGS. 7, 10, 21), the warp thread holder may be turned as by adjustment by a defined angle around its longitudinal axis, preferably by an angle of 30°, so that the opening of the warp thread holder may be disposed inclined relative to the plane of stroke of the thread guiding device. The advantage of this design is that a higher tension is applied to the leno yarn as the leno yarn is lifted from the support catch by the warp thread holder, so that the leno yarn is always safely lifted from said catch.

Figure 22:
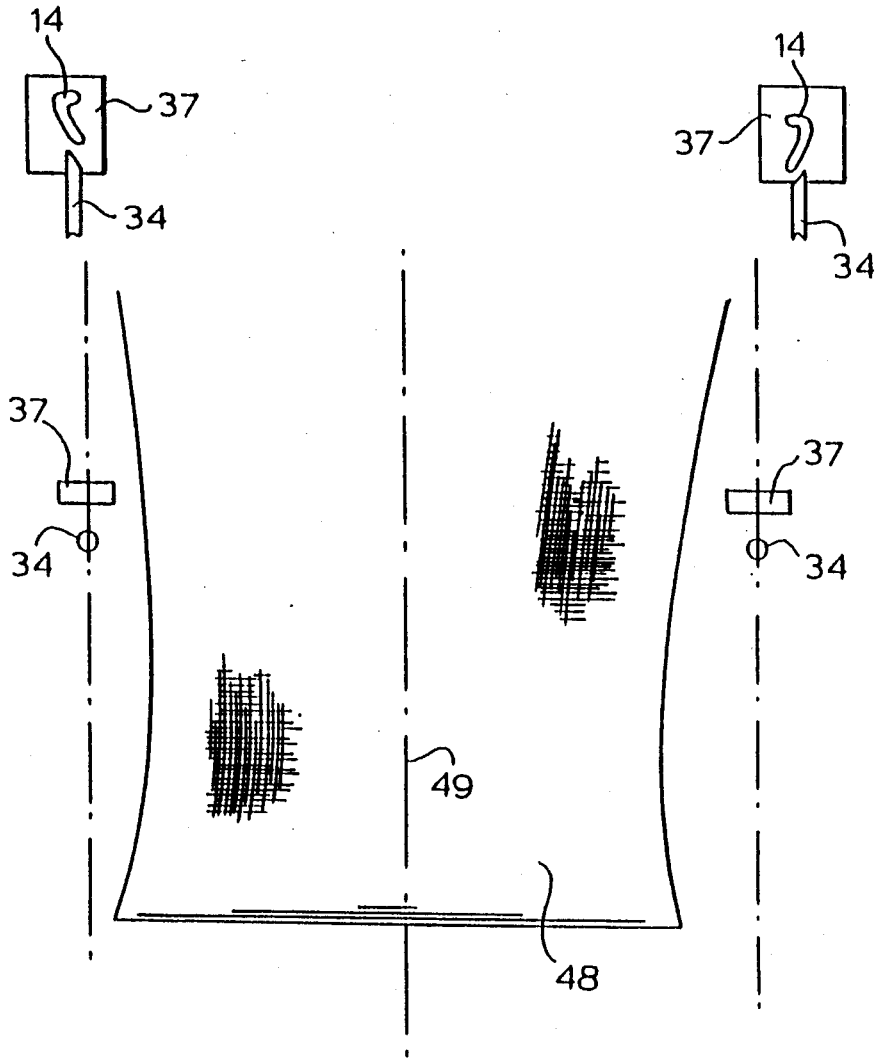
FIG. 22 shows the application of the embodiment according to FIG. 1 in connection with a fabric.

In FIG. 22 there is shown the environment of the machine of FIG. 1 with a fabric 48. As can be seen, a thread guiding device 37 is arranged on each side of fabric 48 so that support catch 14 of each device 37 is pointed in the direction of the center 49 of fabric 48 and are thus disposed in a mirror inverted arrangement with respect to each other.

While a few embodiments of the present invention have been shown and described, it will be obvious that many changes and modifications may be made thereunto without departing from the spirit and scope of the invention.

What is claimed is:

1. In a weaving machine including means for forming a leno edge wherein the leno thread alternately passes above and below the warp thread, said machine having reciprocally moving shafts, and at least one needle supported by means of a frame arranged on a first one of said shafts and having an opening for guiding at least one warp thread, the improvement comprising a thread guiding device arranged on a second one of said shafts, said device being guided by said frame and having a slanted slot with a support catch at one end thereof for guiding the leno yarn so that said leno yarn alternately runs along opposing sides of and in contact with said needle, the diameter of said needle beneath the opening for the warp thread is reduced so that a reduction in cross section thereof is obtained within the area of contact with the leno yarn.

2. The weaving machine as defined in claim 1, wherein said thread guiding device is provided with two slanted slots each having a supoprt catch at one end thereof.

3. The weaving machine as defined in claim 2, wherein said two slanted slots in said thread guiding device are disposed in a mirror inverted arrangement with respect to each other.

4. The weaving machine as defined in claim 3, wherein said machine includes two needles, respectively associated with said two slanted slots, said needles having deflecting surfaces at their ends associated with the slanted slots, and said needles being disposed in a mirror inverted arrangement with respect to each other.

5. The weaving machine as defined in claim 1, wherein said needle is in the form of a needle and said slanted slot is sligntly greater in its horizontal reach than the thickness of the associated needle of said at least one warp thread holder.

6. The weaving machine as defined in claim 1, wherein said needle has a deflecting surface at its end associated with the support catch of said slanted slot.

7. The weaving machine as defined in claim 6, wherein said needle may be rotated by adjustment about its longitudinal axis by a defined angle, so that the opening for guiding the warp thread is disposed inclined with respect to the plane of the direction of stroke of the thread guiding device.

8. The weaving machine as defined in claim 7, wherein said defined angle is 30 degrees.

9. The weaving machine as defined in claim 1, wherein said thread guiding device includes a further opening for guiding another warp thread.

10. The weaving machine as defined in claim 9, wherein said further opening in said thread guiding device is disposed within the area of the top end of the slanted slot provided in the thread guiding device and, wherein said weaving machine includes two needles, said further opening being disposed in said area between said two needles.

11. The weaving machine as defined in claim 9, wherein said machine includes two needles, and said slanted slot, with respect to its horizontal extension, extends slightly beyond the outer spacing of said needles.

12. The weaving machine as defined in claim 1, wherein a thread guiding device is associated with each side of a fabric and arranged in a way such that the support catch in each thread guiding device points in the direction of the center of the fabric so as to be disposed in a mirror inverted arrangement with respect to each other.

* * * * *